US005731135A

United States Patent [19]

Twist et al.

[11] Patent Number: 5,731,135

[45] Date of Patent: Mar. 24, 1998

[54] PHOTOGRAPHIC DEVELOPER/AMPLIFIER COMPOSITIONS

[75] Inventors: Peter Jeffery Twist, Missenden; Christopher John Winscom, Pinner, both of United Kingdom

[73] Assignee: Eastman Kodak Company, Rochester, N.Y.

[21] Appl. No.: 791,232

[22] Filed: Jan. 30, 1997

Related U.S. Application Data

[62] Division of Ser. No. 557,784, Nov. 13, 1995.

[30] Foreign Application Priority Data

Nov. 19, 1994 [GB] United Kingdom ..... 9423381

[51] Int. Cl.[6] ..... G03C 7/413

[52] U.S. Cl. ..... 430/450; 430/373; 430/414; 430/490; 430/492; 430/943

[58] Field of Search ..... 430/373, 414, 430/450, 490, 492, 943

[56] References Cited

U.S. PATENT DOCUMENTS 4,045,225 8/1977 Shimamura et al. ..... 430/373

4,529,687 7/1985 Hirai et al. ..... 430/373

5,358,830 10/1994 Twist ..... 430/943

*Primary Examiner*—Hoa Van Le

*Attorney, Agent, or Firm*—J. Lanny Tucker

[57] ABSTRACT

An aqueous redox amplifier solution having a pH in the range 10.0 to 13.5 comprises:

a color developing agent and/or auxiliary developing agent, hydrogen peroxide or a compound that provides hydrogen peroxide in a concentration equivalent to 0.1 to 50.0 ml/l of 30% w/w solution, and a borate or other complexing compound capable of reversibly forming a complex with hydrogen peroxide, the complexing compound being in a concentration of from 1.0 to 100.0 g/l, and wherein the relative amounts of complexing compound and hydrogen peroxide are such as to provide an amount of hydrogen peroxide effective for redox amplification and buffer the hydrogen peroxide and thereby reduce the decline in the rate of redox amplification. This solution is useful for processing color photographic elements.

6 Claims, No Drawings

PHOTOGRAPHIC DEVELOPER/AMPLIFIER COMPOSITIONS

This a Divisional of application Ser. No. 08/557,784, filed 13 Nov., 1995, now allowed.

FIELD OF THE INVENTION

This invention relates to photographic developer/amplifier solutions useful in redox amplification processes.

BACKGROUND OF THE INVENTION

Redox amplification processes have been described, for example in British Specifications Nos. 1,268,126; 1,399,481; 1,403,418; and 1,560,572. In such processes color materials are developed to produce a silver image (which may contain only small amounts of silver) and then treated with a redox amplifying solution (or a combined developer/amplifier) to form a dye image.

The developer-amplifier solution contains a color developing agent and an oxidizing agent that will oxidize the color developing agent in the presence of the silver image which acts as a catalyst.

Oxidized color developer reacts with a color coupler to form the dye image. The amount of dye formed depends on the time of treatment or the availability of the color coupler and is less dependent on the amount of silver in the image than is the case in conventional color development processes.

Examples of suitable oxidizing agents include peroxy compounds including hydrogen peroxide and compounds that provide hydrogen peroxide, e.g., addition compounds of hydrogen peroxide, cobalt(III) complexes including cobalt hexammine complexes, and periodates.

When hydrogen peroxide is used as the oxidizing agent the rate of amplification depends on the level of hydrogen peroxide in the solution and this falls with time due to reaction with the color developing agent, antioxidant (if present) and dismutation. This loss of concentration of hydrogen peroxide is a problem. For example, because in a continuous process the concentration must be made up, it introduces a risk of either over or under replenishment of the hydrogen peroxide concentration.

The present invention provides a solution to this problem by addition of boric acid or a borate (hereafter referred to collectively as borate) or other complexing compound capable of reversibly complexing with hydrogen peroxide to the developer solution. The borate or other complexing compound forms a reversible complex with the hydrogen peroxide and, as the hydrogen peroxide in the solution is used up, the complex will dissociate to provide a buffering effect, tending to stabilize the level of hydrogen peroxide in the solution and thereby reducing the decline in the rate of redox amplification.

Perborates that are complexes of borates and hydrogen peroxide and which readily dissociate in solution have been previously described in redox amplification, where they have been used as a source of hydrogen peroxide, for example in G.B. Patent Nos. 1,524,438 and 1,546,739. Sodium perborate that is usually represented by the formula $NaBO_3$ $4H_2O$ and is a complex of sodium metaborate (formula $NaBO_2$) and hydrogen peroxide has been described in GB patent No. 1,546,739 as a source of hydrogen peroxide. The perborates whose use has been described have molar proportions of borate and hydrogen peroxide of approximately 1:1 and do not provide the above mentioned buffering effect.

SUMMARY OF THE INVENTION

According to the present invention there is provided an aqueous redox amplifier solution having a pH in the range 10.0 to 13.5 comprising:

- a color developing agent and/or auxiliary developing agent,
- hydrogen peroxide or a compound that provides hydrogen peroxide in a concentration equivalent to 0.1 to 50.0 ml/l of 30% w/w solution, and
- a borate or other complexing compound capable of reversibly forming a complex with hydrogen peroxide,
- the complexing compound being in a concentration of from 1.0 to 100.0 g/l, and
- wherein the relative amounts of complexing compound and hydrogen peroxide are such as to provide an amount of hydrogen peroxide effective for redox amplification and to buffer the hydrogen peroxide and thereby reduce the decline in the rate of redox amplification.

Boric acid, alternatively known as boracic acid, which is of formula $H_3BO_3$ is particularly suitable for use in the present invention. Besides boric acid itself, its salts and esters and those of metaboric acid hereafter referred to as metaborates can be used, for example, sodium metaborate, e.g., of formula $NaBO_2$ $4H_2O$.

Also complex borates containing more than one boron atom in the anion such as tetraborates, also known as pyroborates, e.g., sodium pyroborate decahydrate of formula $Na_2B_4O_7$ $10H_2O$ commonly known as borax may also be used in the present invention.

By use of the present invention the sensitometric change due to the aging of redox amplifier/developers is reduced. Further the effect of over or under replenishment in a continuous process is reduced. A further advantage is that the effect of a succession of high or low density prints passing through a low volume processor will be reduced and also the effect on sensitometry of any local depletion or build up of peroxide caused by insufficient agitation will be reduced.

DETAILED DESCRIPTION OF THE INVENTION

When the complexing compound is a borate containing one boron atom in the anion, preferably the molar ratio of borate to hydrogen peroxide is at least 2:1, more preferably at least 5:1 and can exceed 10:1, but preferably does not exceed 20:1.

Preferably the pH of the aqueous redox amplifier solution is in the range from 10.5 to 12.0. The concentration range of the hydrogen peroxide in the redox amplifier solution is preferably equivalent to 0.5 to 10.0 ml/l of 30% w/w solution.

Hydrogen peroxide is frequently supplied as a 30% w/w aqueous solution. However peroxide of a different concentration can be used to make up the solutions of the invention provided the amount of hydrogen peroxide is the same as that in the specified amount of 30% w/w solution.

The concentration range of borate is preferably from 5.0 to 40.0 g/l.

Unless the context clearly requires otherwise, references in this specification to the concentration of hydrogen peroxide and borate or other complexing compound are to the total amounts of these materials in the redox amplifier solution, i.e., both free and complexed.

A convenient way of measuring the rate of redox amplification for a given solution is by the well-known sensitometric method that measures the color development using a preexposed test strip and involves measuring the dye Dmax values for red, green and blue.

Preferably the relative amounts of borate or other complexing compound and hydrogen peroxide in the solution are such as to provide a solution whose sensitometric values are substantially equal to those of a freshly prepared solution containing no complexing compound and a hydrogen peroxide concentration equivalent to 0.5 to 5.0 ml/l of 30% w/w solution.

Any of the color developing agents known in the art may be used in the present invention, for example, the p-phenylene dieunine color developing agents.

The term auxiliary developing agent is well known in the art and includes compounds known as electron transfer agents such as Phenidone and its derivatives, p-amino phenols and certain substituted p-phenylene diamines, e.g., N,N,N',N'-tetramethyl p-phenylene diamine.

Preferred amounts of color developing agent are from 0.5 to 10 g/l and more preferably from 1 to 7.5 g/l.

Certain redox amplification systems have the color developing agent associated with the material being developed, e.g., immobilized in a layer on the paper rather than the redox amplifier solution and employ an auxiliary developing agent in the solution. The present invention can be used with such systems by providing the auxiliary developing agent in the redox amplifier solution.

The solution may also contain other additives, for example, antioxidants, sequestrants and buffers.

Examples of suitable antioxidants are substituted or unsubstituted hydroxylamines (such as N-iso-propyl-N-sulfonato-ethylhydroxylamine, diethylhydroxylamine) and hydroxylamine and salts thereof such as the sulphate, chloride or phosphate. Typical amounts are in the range from 0.25 to 5.5 (as hydroxylamine sulphate). Other hydroxylamines are described in U.S. Pat. Nos. 4,876,174 and 5,354,646.

The phosphate buffer may be potassium hydrogen phosphate ($K_2HPO_4$), or other phosphates, carbonates, silicates or mixtures thereof.

The solutions of the present invention can be prepared by dissolving the borate in water and adding hydrogen peroxide solution and the other components. Alternatively the hydrogen peroxide and borate can be added to the water in the form of a complex, e.g., as a perborate such as sodium perborate. As stated above, sodium perborate that has been previously described for use in redox amplification contains hydrogen peroxide and sodium metaborate in 1:1 molar proportions. In order to obtain a solution having the buffering effect according to the invention it is necessary to add further borate preferably to produce a molar ratio of at least 2:1.

According to another aspect of the invention a process for the preparation of a redox amplifier solution as herein before defined comprises either (i) dissolving the compounds in water in the amounts defined above or alternatively (ii) providing the peroxide in the form of a complex such as a perborate and adjusting the molar ratio of borate to hydrogen peroxide to obtain the buffering effect.

In the preparation of the solutions according to the invention the compounds may be added in any order.

According to a further aspect of the invention, a method of redox amplification comprises subjecting an exposed color photographic material to redox amplification using a solution as herein before defined.

The photographic material may be first subjected to a development step with a developer solution containing no peroxide before the redox amplification. Alternatively the development and amplification may be combined in a single step using a combined developer/amplifier solution.

Color photographic material to be processed by the redox amplifier solution of the present invention may be of any type but will preferably contain low amounts of silver halide. Preferred total silver halide coverages are in the range 6 to 300, preferably 10 to 200 mg/m$^2$ and particularly 10 to 100 mg/m$^2$ (as silver).

The material may comprise the emulsions, sensitizers, couplers, supports, layers, additives, etc., described in Research Disclosure, December 1978, Item 17643, published by Kenneth Mason Publications Ltd., Dudley Annex, 12a North Street, Emsworth, Hants PO10 7DQ, UK.

In a preferred embodiment the photographic material to be processed comprises a resin coated paper support and the emulsion layers comprise more than 80%, preferably more than 90% silver chloride and are more preferably composed of substantially pure silver chloride.

The photographic materials can be single color materials or multicolor materials. Multicolor materials contain dye image forming units sensitive to each of the three primary regions of the spectrum. Each unit can be comprised of a single emulsion layer of multiple emulsion layers sensitive to a given region of the spectrum. The layers of the materials, including the layers of the image-forming units can be arranged in various orders as is known in the art.

A typical multicolor photographic material comprises a support bearing a yellow dye image-forming unit comprised of at least one blue sensitive silver halide emulsion layer having associated therewith at least one yellow dye-forming coupler, and magenta and cyan dye image-forming units comprising at least one green or red sensitive silver halide emulsion layer having associated therewith at least one magenta or cyan dye-forming coupler respectively. The material can contain additional layers, such as filter layers.

The invention is illustrated by the following Examples of which Examples 1 and 3 are not according to the invention and are included for comparative purposes.

In the Examples the following process cycle was used:

develop: details of developer/amplifier and times given in Tables 1 and 6 stop: 30 seconds with a solution of sodium metabisulphite (15 g/l)

bleach-fix: 45 seconds in a solution of pH 6.2 containing 75 ml/l of ammonium ferric ethylene diamine tetraacetic acid (1.56 M), 80 ml/l of ammonium thiosulphate (58%) and 7.5 g/l of anhydrous sodium sulphite, wash: 90 seconds with water and finally drying in warm air.

EXAMPLE 1.

A redox split developer system consisting of a first developer followed by a developer/amplifier of the composition shown in Table 1 was left to age without any replenishment.

TABLE 1

| | | |
|---|---|---|
| sequestrant 1 | 0.9 g/l | 0.6 g/l |
| sequestrant 2 | 3.0 ml/l | 2.0 ml/l |
| $K_2HPO_4.3H_2O$ | 30 g/l | 20 g/l |

TABLE 1-continued

| | | |
|---|---|---|
| KBr | 1 mg/l | 1 mg/l |
| KCl | 1.0 g/l | 0.7 g/l |
| component 3 | 0.45 g/l | 0.3 g/l |
| component 4 | 3.0 ml/l | 2.0 ml/l |
| component 5 | 5.5 g/l | 1.5 g/l |
| pH | 11.7 | 11.2 |
| $H_2O_2$ (30%) | nil | 1.3 ml/l |
| Time | 15 sec | 45 sec |
| Temperature | 32° C. | 32° C. |

Sequestrant 1 is a 60% solution of 1-hydroxy-ethylidene-1,1-diphosphonic acid.

Sequestrant 2 is a 41% solution of the penta sodium salt of diethylenetriaminepentaacetic acid.

Component 3 is catechol disulphonate.

Component 4 is an 85% solution of diethylhydroxylamine used as an antioxidant, and Component 5 is 4-N-ethyl-N-(beta-methanesulphonamidoethyl)-o-toluidene sesquisulphate as a color developing agent.

The sensitometric response was measured at intervals of time by treating a preexposed low silver control strip with the solutions for the times stated and measuring the dye Dmax values that are recorded in Table 2.

TABLE 2

Dmax (times 100) with time (no boric acid)

| Time (hours) | R | G | B |
|---|---|---|---|
| 0 | 267 | 267 | 231 |
| 1.83 | 270 | 270 | 231 |
| 3.5 | 268 | 268 | 230 |
| 5.0 | 248 | 258 | 231 |
| 6.42 | 220 | 240 | 229 |
| 23 | 76 | 98 | 99 |

It can be seen from Table 2 that the red, green and blue Dmax values fall with time.

In another experiment the same developer/amplifier solution was prepared except that 30 g/l of boric acid was added and the pH adjusted back to 11.2. When used as a developer/amplifier it was found that a much reduced dye image was formed as compared with the freshly prepared solution containing no boric acid. This shows that when hydrogen peroxide is complexed with boric acid it is not free to act as an oxidizing agent.

The experiments recorded in Example 1 are included for comparative purposes only.

EXAMPLE 2

Four solutions of the composition given in Table 1 containing 30 g/l of boric acid were prepared and to each solution a different amount of hydrogen peroxide was added and the sensitometric response measured.

The amounts of hydrogen peroxide and Dmax values are recorded in Table 3.

TABLE 3

Dmax and peroxide level

| | Dmax (times 100) | | |
|---|---|---|---|
| Peroxide level (ml/l) | R | G | B |
| 1.3 | 125 | 164 | 198 |
| 2.7 | 164 | 217 | 238 |
| 4.0 | 206 | 245 | 235 |
| 5.0 | 235 | 260 | 238 |

It can be seen that increasing the level of hydrogen peroxide progressively restores the sensitometric response and that the latter is almost fully restored when the level of peroxide is approximately 4 times the original level in the absence of the boric acid, i.e., 5.0 ml/l against 1.3 ml/l. This indicates that only a fraction of the hydrogen peroxide is free to act as an oxidizing agent and that most of the peroxide is complexed with the boric acid.

The standing stability of the solution containing 5.0 ml/l of hydrogen peroxide was measured and the results recorded in Table 4.

TABLE 4

Dmax (times 100) with time boric acid, 5 ml/l peroxide

| Time hours | R | G | B |
|---|---|---|---|
| 0 | 235 | 260 | 238 |
| 2.5 | 237 | 261 | 239 |
| 3.5 | 234 | 258 | 236 |
| 5.0 | 232 | 257 | 238 |
| 6.42 | 230 | 256 | 239 |
| 23 | 189 | 226 | 220 |

These results show that the fall off in activity of the solution is much reduced as compared with the solution in Table 2 containing no boric acid and only 1.3 ml/l of hydrogen peroxide.

EXAMPLE 3

A developer solution of composition as detailed in Table 1, i.e., containing no boric acid was prepared and hydrogen peroxide added to a concentration of 5 ml/l. The standing stability was measured by measuring the Dmax values at intervals of time and the results are given in Table 5.

TABLE 5

Dmax (times 100) with time: no boric acid.

| Time hours | R | G | B |
|---|---|---|---|
| 0 | 275 | 273 | 198 |
| 2.5 | 273 | 273 | 195 |
| 3.5 | 273 | 271 | 195 |
| 5.0 | 267 | 265 | 191 |
| 6.42 | 242 | 239 | 190 |
| 23 | 81 | 96 | 101 |

These results show that the standing stability is inferior to that recorded in Table 4 (which is for the same solution but containing boric acid).

The improved stability is therefore due to the combination of boric acid and increased peroxide and not to the increased peroxide alone.

EXAMPLE 4

In this example boric acid is used in a redox process that consists of a single developer/amplifier (SDA) solution unlike the previous examples which used developer followed by developer/amplifier. The composition of the developer/amplifier is given in

TABLE 6

| | SDA 1 | SDA 2 | SDA 3 |
|---|---|---|---|
| sequestrant 1 | 0.6 g/l | 0.6 g/l | 0.6 g/l |
| sequestrant 2 | 2.0 ml/l | 2.0 ml/l | 2.0 ml/l |
| $K_2HPO_4.3H_2O$ | 20.0 g/l | 20.0 g/l | 20.0 g/l |
| KBr | 1.0 mg/l | 1.0 mg/l | 1.0 mg/l |
| KCl | 0.7 g/l | 0.7 g/l | 0.7 g/l |
| component 3 | 0.3 g/l | 0.3 g/l | 0.3 g/l |
| component 4 | 2.0 g/l | 2.0 g/l | 2.0 g/l |
| component 5 | 3.5 g/l | 3.5 g/l | 3.5 g/l |
| boric acid | 0 | 15 g/l | 30.0 g/l |
| pH | 11.5 | 11.5 | 11.5 |
| $H_2O_2$ | 1.5 ml/l | 2.5 ml/l | 2.5 ml/l |
| Time | 45 seconds | 45 seconds | 45 seconds |
| Temperature | 32° C. | 32° C. | 32° C. |

Components 3, 4 and 5 were as previously identified in Table 1.

SDA 1 was the control developer/amplifier and the other developer/amplifier solutions were made to demonstrate the invention. The sensitometric response of a three-color multilayer was monitored over a period of time and the results for Dmax as a function of the age of the developer/amplifier solutions are shown in Table 7. After 24 hours an additional 1.5 ml/l of hydrogen peroxide (30%) was added to each developer/amplifier and the monitoring was continued for another 6 hours.

TABLE 7

| | Dmax times 100 | | | | | | | | |
|---|---|---|---|---|---|---|---|---|---|
| | SDA 1 | | | SDA 2 | | | SDA 3 | | |
| Time hours | R | G | B | R | G | B | R | G | B |
| 0 | 269 | 265 | 199 | 254 | 264 | 249 | 181 | 217 | 224 |
| 1 | 270 | 267 | 197 | 254 | 265 | 251 | 179 | 218 | 225 |
| 3 | 269 | 266 | 200 | 245 | 259 | 242 | 174 | 213 | 220 |
| 5 | 268 | 266 | 215 | 233 | 252 | 239 | 169 | 210 | 221 |
| 6 | 259 | 263 | 221 | 237 | 256 | 246 | 168 | 208 | 221 |
| 24 | 073 | 097 | 102 | 140 | 172 | 197 | 144 | 181 | 199 |
| perox-ide added | 268 | 261 | 157 | 259 | 263 | 221 | 221 | 248 | 230 |
| 25 | 241 | 238 | 141 | 251 | 259 | 216 | 212 | 242 | 222 |
| 27 | 132 | 142 | 114 | 220 | 241 | 203 | 208 | 240 | 226 |
| 29 | 084 | 104 | 102 | 179 | 208 | 181 | 194 | 229 | 220 |
| 30 | 078 | 098 | 097 | 166 | 192 | 175 | 195 | 228 | 224 |

It can be seen from this data that the solutions containing boric acid maintain Dmax values better than the control developer/amplifier (SDA 1) which essentially has no amplification after 24 hours. On the second day after the addition of 1.5 ml/l of hydrogen peroxide (30%) to all the developer/amplifier solutions, SDA 2 and SDA 3 are even more beneficial.

The invention has been described in detail with particular reference to preferred embodiments thereof, but it will be understood that variations and modifications can be effected within the spirit and scope of the invention.

We claim:

1. A process for the preparation of a redox amplifier solution having a pH in the range of 10.0 to 13.5, and comprising:

a color developing agent and/or auxiliary developing agent, hydrogen peroxide or a compound that provides hydrogen peroxide in a concentration equivalent to 0.1 to 50.0 mol/l of a 30% w/w solution, and a borate complexing compound capable of reversibly forming a complex with hydrogen peroxide, said borate complexing compound being present in a concentration of from 1.0 to 100.0 g/l, and wherein the molar ratio of said borate complexing compound to hydrogen peroxide is at least 2:1, such as to buffer the hydrogen peroxide and thereby reduce the decline in the rate of redox amplification, which process comprises either:

(i) dissolving the compounds in water in the defined amounts, or (ii) providing the hydrogen peroxide in the form of a complex that dissolves in water to provide both borate and hydrogen peroxide, and adjusting the molar ratio of borate to hydrogen peroxide to obtain said molar ratio.

2. The process of claim 1 wherein hydrogen peroxide is provided in the form of perborate.

3. The process of claim 1 wherein the molar ratio of borate to hydrogen peroxide is adjusted to be at least 5:1.

4. The process of claim 1 wherein the concentration of provided hydrogen peroxide is in the range equivalent to 0.5 to 10.0 ml/l of a 30% w/w solution.

5. The process of claim 1 wherein the concentration of borate is from 5.0 to 40.0 g/l.

6. The process of claim 1 wherein said solution is buffered with a phosphate.

* * * * *